US010724328B2

(12) United States Patent
Krüger

(10) Patent No.: US 10,724,328 B2
(45) Date of Patent: Jul. 28, 2020

(54) DOWNHOLE TOOL STRING FOR PLUG AND ABANDONMENT BY CUTTING

(71) Applicant: WELLTEC A/S, Allerød (DK)

(72) Inventor: Christian Krüger, Allerød (DK)

(73) Assignee: Welltec A/S, Allerød (DK)

( * ) Notice: Subject to any disclaimer, the term of this patent is extended or adjusted under 35 U.S.C. 154(b) by 156 days.

(21) Appl. No.: 15/566,826

(22) PCT Filed: Apr. 21, 2016

(86) PCT No.: PCT/EP2016/058886
§ 371 (c)(1),
(2) Date: Oct. 16, 2017

(87) PCT Pub. No.: WO2016/170048
PCT Pub. Date: Oct. 27, 2016

(65) Prior Publication Data

US 2018/0100373 A1 Apr. 12, 2018

(30) Foreign Application Priority Data

Apr. 22, 2015 (EP) ..... 15164741

(51) Int. Cl.
*E21B 33/134* (2006.01)
*E21B 29/00* (2006.01)
(Continued)

(52) U.S. Cl.
CPC ..... *E21B 33/134* (2013.01); *E21B 29/002* (2013.01); *E21B 29/005* (2013.01);
(Continued)

(58) Field of Classification Search
CPC ..... E21B 29/002; E21B 29/005; E21B 33/13
See application file for complete search history.

(56) References Cited

U.S. PATENT DOCUMENTS 4,619,318 A * 10/1986 Terrell ..... E21B 29/02 166/212
4,889,187 A * 12/1989 Terrell ..... E21B 29/02 166/298

(Continued)

FOREIGN PATENT DOCUMENTS

CA 2331381 A1 * 11/1999 ..... E21B 29/005
EP 2 363 573 9/2011

(Continued)

OTHER PUBLICATIONS

International Search Report for PCT/EP2016/058886 dated Aug. 1, 2016, 5 pages.

(Continued)

*Primary Examiner* — Jennifer H Gay
(74) *Attorney, Agent, or Firm* — Nixon & Vanderhye P.C.

(57) ABSTRACT

The present invention relates to a downhole plug and abandonment system (100) for a well (105), comprising a first well tubular metal structure (101*a*) having a wall, a second well tubular metal structure (101*b*) having a wall, the second well tubular metal structure being arranged inside the first well tubular metal structure, the well tubular metal structures having longitudinal extensions and being arranged in a borehole (104) of a well, a packer (350) arranged between the first well tubular metal structure and the second well tubular metal structure defining an annular space (351) above the packer, a first plug (106) arranged in the second well tubular metal structure dividing the second well tubular metal structure into a first part (107) and a second part (108), the first part being closest to a top of the well, and a cement plug (270) arranged in the first part on top of the packer and the plug. Furthermore, the present invention relates to a downhole plug and abandonment method.

20 Claims, 14 Drawing Sheets

(51) Int. Cl.

| | |
|---|---|
| ***E21B 33/13*** | (2006.01) |
| ***E21B 29/12*** | (2006.01) |
| ***E21B 33/14*** | (2006.01) |
| ***E21B 47/00*** | (2012.01) |
| ***E21B 23/01*** | (2006.01) |
| ***F04B 19/22*** | (2006.01) |

(52) U.S. Cl.
CPC ..... *E21B 29/12* (2013.01); *E21B 33/13* (2013.01); *E21B 33/14* (2013.01); *E21B 47/0005* (2013.01); *E21B 23/01* (2013.01); *F04B 19/22* (2013.01)

(56) References Cited

U.S. PATENT DOCUMENTS

| | | | | |
|---|---|---|---|---|
| 5,472,052 | A * | 12/1995 | Head | E21B 33/13 166/298 |
| 6,715,543 | B1 * | 4/2004 | Svindland | E21B 33/02 166/192 |
| 7,380,603 | B2 * | 6/2008 | Jeffrey | E21B 23/01 166/285 |
| 9,022,117 | B2 * | 5/2015 | Segura | E21B 29/002 166/298 |
| 9,488,024 | B2 * | 11/2016 | Hoffman | E21B 33/035 |
| 9,587,466 | B2 * | 3/2017 | Burguieres | E21B 41/0007 |
| 9,702,216 | B2 * | 7/2017 | Larsen | E21B 33/13 |
| 9,938,781 | B2 * | 4/2018 | Bansal | E21B 29/002 |
| 9,951,580 | B2 * | 4/2018 | Moyes | E21B 33/12 |
| 10,190,387 | B2 * | 1/2019 | Hemmingsen | E21B 33/13 |
| 10,214,988 | B2 * | 2/2019 | Sabins | E21B 33/13 |
| 2005/0263282 | A1 * | 12/2005 | Jeffrey | E21B 23/01 166/281 |
| 2008/0053652 | A1 | 3/2008 | Corre et al. | |
| 2009/0294127 | A1 * | 12/2009 | Krueger | E21B 29/005 166/298 |
| 2011/0042081 | A1 * | 2/2011 | Streich | C09K 8/42 166/269 |
| 2011/0042087 | A1 * | 2/2011 | Challacombe | E21B 33/13 166/286 |
| 2011/0203795 | A1 * | 8/2011 | Murphy | C09K 8/42 166/292 |
| 2011/0214861 | A1 * | 9/2011 | Rogers | E21B 33/1208 166/281 |
| 2011/0220357 | A1 * | 9/2011 | Segura | E21B 29/002 166/298 |
| 2012/0234542 | A1 * | 9/2012 | McFall | E21B 33/124 166/297 |
| 2012/0305251 | A1 * | 12/2012 | Solversen | E21B 43/114 166/298 |
| 2013/0269948 | A1 * | 10/2013 | Hoffman | E21B 33/035 166/351 |
| 2013/0319671 | A1 * | 12/2013 | Lund | E21B 33/13 166/285 |
| 2014/0114892 | A1 * | 4/2014 | Quirein | E21B 47/0005 706/20 |
| 2014/0326470 | A1 * | 11/2014 | Tinnen | E21B 33/134 166/385 |
| 2014/0367102 | A1 * | 12/2014 | Larsen | E21B 33/13 166/285 |
| 2015/0101812 | A1 * | 4/2015 | Bansal | E21B 29/002 166/298 |
| 2015/0144340 | A1 * | 5/2015 | Surjaatmadja | E21B 29/005 166/298 |
| 2015/0152708 | A1 * | 6/2015 | Smith | E21B 33/13 166/292 |
| 2015/0211314 | A1 * | 7/2015 | McAfee | E21B 29/005 166/250.01 |
| 2016/0010415 | A1 * | 1/2016 | Myhre | E21B 33/13 166/290 |
| 2016/0076341 | A1 * | 3/2016 | Burguieres | E21B 41/0007 166/340 |
| 2016/0194947 | A1 * | 7/2016 | Suparman | E21B 29/00 |
| 2016/0202387 | A1 * | 7/2016 | Fox | E21B 47/0005 73/152.58 |
| 2016/0230499 | A1 * | 8/2016 | Hemmingsen | E21B 33/13 |
| 2016/0290847 | A1 * | 10/2016 | Gronsberg | E21B 47/101 |
| 2016/0348455 | A1 * | 12/2016 | Haq | E21B 29/005 |
| 2017/0016304 | A1 * | 1/2017 | Moyes | E21B 33/12 |
| 2017/0044864 | A1 * | 2/2017 | Sabins | E21B 33/14 |
| 2017/0234099 | A1 * | 8/2017 | Wright | E21B 33/00 166/386 |
| 2018/0066489 | A1 * | 3/2018 | Pipchuk | E21B 33/12 |
| 2018/0100373 | A1 * | 4/2018 | Kruger | E21B 29/002 |
| 2018/0142545 | A1 * | 5/2018 | Lei | G01N 29/265 |
| 2018/0216431 | A1 * | 8/2018 | Walton, III | E21B 23/06 |
| 2018/0216432 | A1 * | 8/2018 | Nelson | E21B 29/002 |
| 2018/0245450 | A1 * | 8/2018 | Stokes | E21B 29/02 |
| 2018/0252069 | A1 * | 9/2018 | Abdollah | E21B 28/00 |
| 2018/0298715 | A1 * | 10/2018 | Shafer | E21B 33/1208 |
| 2019/0178050 | A1 * | 6/2019 | Hemmingsen | E21B 33/13 |

FOREIGN PATENT DOCUMENTS

| | | | | |
|---|---|---|---|---|
| EP | 2 813 665 | | 12/2014 | |
| GB | 2523910 | A * | 9/2015 | E21B 33/12 |
| GB | 2534546 | A * | 8/2016 | E21B 33/13 |
| WO | WO 00/70183 | | 11/2000 | |
| WO | WO-2011059338 | A1 * | 5/2011 | E21B 43/114 |
| WO | WO-2013095154 | A1 * | 6/2013 | E21B 33/134 |
| WO | WO 2013/115652 | | 8/2013 | |
| WO | WO-2018191158 | A1 * | 10/2018 | E21B 33/1208 |
| WO | WO-2019032116 | A1 * | 2/2019 | E21B 33/13 |

OTHER PUBLICATIONS

Written Opinion of the ISA for PCT/EP2016/058886 dated Aug. 1, 2016, 6 pages.

Extended European Search Report for 15164741.9 dated Oct. 16, 2015, 8 pages.

* cited by examiner

DOWNHOLE TOOL STRING FOR PLUG AND ABANDONMENT BY CUTTING

This application is the U.S. national phase of International Application No. PCT/EP2016/058886 filed Apr. 21, 2016 which designated the U.S. and claims priority to EP Patent Application No. 15164741.9 filed Apr. 22, 2015, the entire contents of each of which are hereby incorporated by reference.

FIELD OF THE INVENTION

The present invention relates to a downhole plug and abandonment system for a well. Furthermore, the present invention relates to a downhole plug and abandonment method.

BACKGROUND ART

When a well becomes less productive, and all attempts to improve the production of hydrocarbons from a reservoir have failed, the unproductive part of the well, if not the whole well, is plugged and abandoned. In some cased wells, the well has parts where the casing or production tubing is surrounded by an annulus which has not been filled with cement during completion. Such cased wells may also have an annular space between the intermediate casing and the production casing in the upper part of the well. In such wells with annulus or annular spaces, the plug and abandonment becomes complicated, since when the casing is filled with cement to plug the well, the cement cannot fill out the annular space or the annulus and there is a risk of a blowout through that annulus or annular space. In order to properly plug the well, a large rig is shipped to the well to pull the production casing out of the well. Such operation is thus, in the known solution, necessary and expensive.

SUMMARY OF THE INVENTION

It is an object of the present invention to wholly or partly overcome the above disadvantages and drawbacks of the prior art. More specifically, it is an object to provide an improved plug and abandonment system capable of plugging also cased wells having an annulus between the casing/production tubing and the formation and/or having an annular space between the intermediate casing and the production casing.

The above objects, together with numerous other objects, advantages and features, which will become evident from the below description, are accomplished by a solution in accordance with the present invention by a downhole plug and abandonment system for a well, comprising:

- a first well tubular metal structure having a wall,
- a second well tubular metal structure having a wall, the second well tubular metal structure being arranged inside the first well tubular metal structure, the well tubular metal structures having longitudinal extensions and being arranged in a borehole of the well,
- a packer arranged between the first well tubular metal structure and the second well tubular metal structure defining an annular space above the packer,
- a first plug arranged in the second well tubular metal structure dividing the second well tubular metal structure into a first part and a second part, the first part being closest to a top of the well, and
- a cement plug arranged in the first part on top of the packer and the plug.

The cement plug may have an outer diameter being equal to an inner diameter of the first well tubular structure.

Furthermore, the cement plug may have a cross-sectional area and the cement plug may be unbroken across the cross-sectional area.

Moreover, the cement plug may be massive.

The downhole plug and abandonment system as described above may further comprise a tool string comprising:

- an anchoring tool section,
- a downhole tubing cutter tool arranged in the first part of the second well tubular metal structure, comprising:
  - a first housing part, and
  - a cutting part projectable from the first housing part, the cutting part having a cutting edge configured to cut in the first part of the second well tubular metal structure for providing access to the annular space, the first housing part being rotatable in relation to the anchoring tool section.

Also, the cutting edge may be configured to cut in the first part of the second well tubular metal structure above the packer in order to provide access to the annular space.

The tool string may be connected to a wireline.

Furthermore, the tool string may comprise an ultrasonic tool.

Moreover, the tool string may be powered through the wireline.

Further, the tool string may be submerged via the wireline.

The first plug may be a cement plug.

Furthermore, the first plug may comprise a first plug part and a second plug part, the plug parts being connected via an elongated connection member and spaced apart along the second well tubular metal structure defining a space, which space may comprise cement.

Additionally, the elongated connection member may be a chain, a wire, a wireline, a cable, a cord, a rod and/or a rope.

Moreover, the first plug part may be arranged closest to the top of the well.

Further, the elongated connection member may be more than 20 metres long, preferably more than 50 metres long, more preferably more than 100 metres long.

The downhole plug and abandonment system as described above may further comprise a pump configured to deliver pressurised fluid pressing onto the first plug part to displace the first plug in the second well tubular metal structure.

Furthermore, the tool string may comprise a stroking tool section configured to move at least the cutting part along the longitudinal extension to remove part of the first part of the second well tubular metal structure.

Additionally, the stroking tool section may comprise a pump unit, a driving unit for driving the pump unit, and an axial force generator comprising an elongated piston housing having a first end and a second end, and a piston provided on a shaft, the shaft penetrating the housing for transmitting the axial force to another tool section of the tool string or of the well tubular metal structures.

The piston may be provided in the piston housing so that the shaft penetrates the piston and each end of the piston housing and divides the piston housing into a first chamber and a second chamber, and the first chamber may be fluidly connected to the pump unit via a duct and the second chamber may be fluidly connected to the pump unit via another duct so that the pump unit can pump fluid into one chamber by sucking fluid from the other chamber in order to move the piston within the piston housing and thereby move the shaft back and forth.

Further, the stroking tool section may have valves in connection with the pump unit in order to control a direction of the fluid in each duct.

Moreover, the piston housing may comprise a tube closed in each end by a ring within the tube, the rings having sealing means for providing a sealing connection to the shaft.

Furthermore, the tube may have a plurality of ducts running from the first chamber to the pump unit and the same number of ducts running from the second chamber to the pump unit.

Additionally, the tube may comprise two tubes, namely an inner tube within an outer tube, and the outside of the inner tube may have grooves which, when placed within the outer tube, may constitute the ducts.

Furthermore, the inner tube may comprise a wall that is substantially thinner than a wall of the outer tube.

Further, the piston may be provided with sealing means for making a sealing connection between the piston and an inside of the piston housing.

Also, the stroking tool section may comprise a plurality of force generators.

Moreover, the plurality of force generators may be provided so that the tube comprises several rings dividing the tube into a number of piston housings where each piston housing may be penetrated by the shaft on which, in each piston housing, a piston may be provided and where a duct may run from each first and second chamber in each piston housing to the pump unit.

In addition, the duct connecting the first chamber and the pump unit may be connected to the first chamber at its end closest to the pump unit, and the duct connecting the second chamber and the pump unit may be connected to the second chamber at its rearmost end in relation to the pump unit.

Furthermore, the pump unit may be a high pressure pump, such as a piston pump, a recirculation pump, a centrifugal pump, a jet pump, or similar pump.

Further, the driving unit may be a motor, such as an electrical motor.

The stroking tool section may comprise a stroking housing, a first chamber, a first tool part comprising a pump unit providing pressurised fluid to the first chamber, a shaft penetrating the chamber, and a first piston dividing the first chamber into a first chamber section and a second chamber section, wherein the piston may be connected to or form part of the stroking housing forming part of a second tool part and may be slidable in relation to the shaft so that the stroking housing moves in relation to the shaft, the shaft being stationary in relation to the pump unit during pressurisation of the first chamber section or of the second chamber section, generating a pressure on the piston, wherein the shaft may be fixedly connected with the first tool part, and wherein the stroking housing may be slidable in relation to the first tool part and may overlap the first tool part.

Moreover, the stroking tool section may further comprise a pressure intensifier arranged downstream of the pump unit to increase the pressure before being fed to the chamber.

Additionally, the shaft may have a through-bore for allowing an electrical conductive means to run through the shaft.

Further, the stroking tool section may comprise a connector, and the stroking housing may comprise a first end part overlapping the first tool part.

Furthermore, the stroking housing may have an inner diameter substantially corresponding to an outer diameter of the first tool part.

Moreover, the shaft and/or the stroking housing may comprise one or more fluid channels for providing fluid to and/or from the chamber during pressurisation of the first chamber section or of the second chamber section, generating a pressure on the piston.

Also, the stroking housing may transfer the axial force.

In addition, the stroking tool section may comprise a second chamber divided by a second piston.

Furthermore, the first chamber and the second chamber may be comprised in the stroking housing.

Moreover, the shaft may comprise an intermediate part dividing the first chamber and the second chamber.

The tool string may comprise a compartment tool section comprising a first compartment having inner faces.

Further, the first compartment may be configured to contain cement.

The first compartment may contain a corrosive fluid or agent during the submersion of the downhole tool string into the well, and the compartment tool section may have an outlet for ejecting the corrosive fluid or agent contained in the first compartment into the well.

The downhole tool string may further comprise a stroking tool section.

Furthermore, the inner faces of the first compartment may be made of a ceramic material or may be fully covered by a ceramic material, such as $S_iO$.

Moreover, the compartment tool section may comprise a second compartment containing a foam generating agent, such as a gas or a liquid.

In addition, the compartment tool section may comprise a foam generating unit having a mixing chamber which may be in fluid communication with the first compartment and the second compartment so that the foam generating agent from the second compartment is mixed with the corrosive fluid or agent in the mixing chamber to provide a corrosive foam to be ejected into the well.

Further, the compartment tool section may comprise an ejecting device for ejecting the corrosive fluid or agent or corrosive foam out through the outlet.

Furthermore, the first compartment may comprise the corrosive fluid or agent or the foam generating unit may be arranged in the first part of the second well tubular metal structure adjacent the structure section so that the corrosive fluid or agent or corrosive foam is ejected from the first compartment or from the foam generating unit to partly or fully corrode the wall of the structure section by means of the corrosive fluid or agent or corrosive foam.

The present invention also relates to a downhole plug and abandonment method comprising the steps of:

- setting a first plug in the second well tubular metal structure of the downhole plug and abandonment system as described above,
- positioning a tool string in the second well tubular metal structure e.g. above the packer,
- cutting into the wall of the second well tubular metal structure to provide access to the annular space defined by the first well tubular metal structure and the second well tubular metal structure and the packer, and
- ejecting cement into the second well tubular metal structure and into the annular space.

Also, before the step of ejecting cement, the method may further comprise the step of investigating a cement layer arranged between the wall of the borehole and the first well tubular metal structure.

Furthermore, the step of investigating the cement layer arranged between the wall of the borehole and the first well tubular metal structure may be performed by means of an ultrasonic tool positioned in the first well tubular metal structure.

The step of cutting into the wall may be performed by moving the cutting part in the longitudinal extension of the second well tubular metal structure.

Moreover, the downhole plug and abandonment method as described above may further comprise a step of inspecting the walls of the well tubular metal structures before the step of cutting.

The step of inspecting the walls may be performed by gamma-ray or x-ray by means of gamma-ray or X-ray transmitters arranged around the well and a detection unit or a logging tool in the well.

Furthermore, the downhole plug and abandonment method may comprise the steps of arranging the first compartment of the downhole tool string as described above in the first part of the well tubular metal structure adjacent the structure section, ejecting the corrosive fluid or agent or corrosive foam into the structure section from the tool section, and corroding the metal wall of the structure section partly or fully from the inside of the structure section to provide a decreased wall thickness of the structure section before cutting.

The downhole plug and abandonment method may further comprise the steps of taking a sample of a well fluid in the well tubular metal structure at least before the step of ejecting the corrosive fluid or agent or corrosive foam, and detecting a content of the well fluid.

Additionally, the downhole plug and abandonment method may further comprise the steps of cutting a section of the second well tubular metal structure, and retracting the section from the well.

Moreover, the downhole plug and abandonment method may further comprise the steps of cutting a second section of the second well tubular metal structure, and retracting the second section from the well.

In addition, the downhole plug and abandonment method may further comprise the steps of cutting additional sections of the second well tubular metal structure, and retracting the additional sections from the well until reaching a predetermined distance above the packer and plug.

A downhole plug and abandonment method as described above may further comprise the step of circulating cement down through the second well tubular metal structure and up through the annular space, until cement is detected in a top part of the annular space, in order to ensure that the annular space is substantially filled with cement.

The downhole plug and abandonment method may further comprise the step of cutting the first well tubular metal structure and the second well tubular metal structure at a distance from the top of the well to remove the well head.

Moreover, the downhole plug and abandonment method may further comprise the steps of arranging the stroking tool section in the top of the second well tubular metal structure and releasing the well head by providing an axial stroke of the stroking tool section.

The downhole plug and abandonment method may further comprise the step of cutting control lines extending in the annular space.

The step of setting the plug in the downhole plug and abandonment method as described above may comprise the steps of inserting the second plug part into the second well tubular metal structure, ejecting cement onto the second plug part while displacing the second plug part into the second well tubular metal structure and the elongated connection member, and inserting the first plug part into the second well tubular metal structure when the elongated connection member is run out of length and the space between the second plug part and the first plug part has been substantially filled with cement.

A downhole plug and abandonment method as described above may further comprise the steps of pressurising a fluid via a pump at the top of the well, and delivering the pressurised fluid onto the first plug part for displacing the plug in the second well tubular metal structure.

A downhole plug and abandonment method as described above may further comprise the step of cutting at least one flow line.

Finally, the step of cutting the flow line may be performed before the step of cementing.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
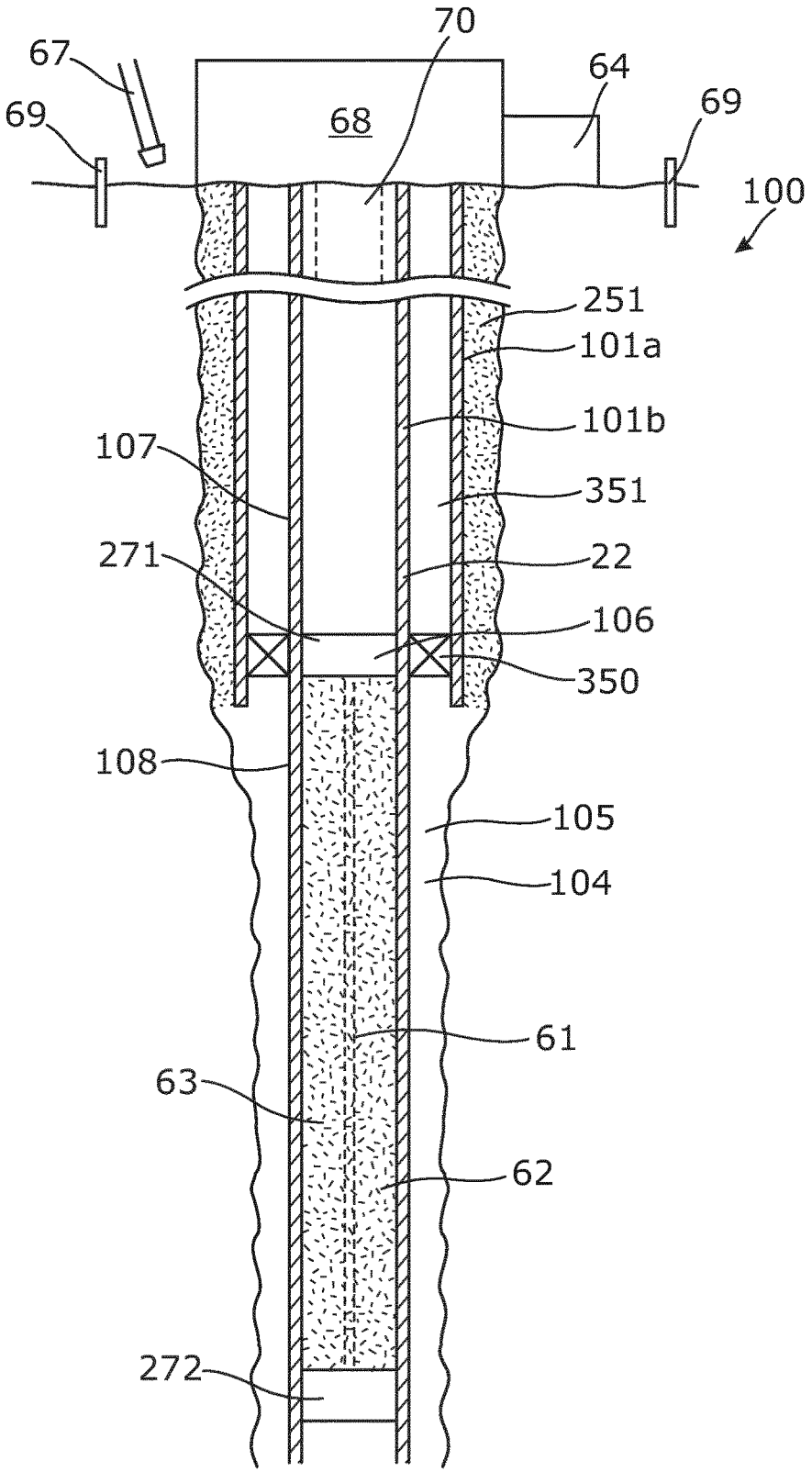
FIG. 1 shows a cross-sectional view of a downhole plug and abandonment system.

FIG. 1 shows a downhole plug and abandonment system 100 for plugging a well 105 safely before abandoning the well, so that the well does not leak over the years to come. The downhole plug and abandonment system 100 comprises a first well tubular metal structure 101*a* having a metal wall and a second well tubular metal structure 101*b* having a metal wall, where the second well tubular metal structure 101*b* is arranged inside the first well tubular metal structure 101*a*. The well tubular metal structures having longitudinal extensions are arranged in a borehole 104 in a formation. A packer 350 is arranged between the first well tubular metal structure and the second well tubular metal structure defining an annular space 351 above the packer and a plug 106, being a first plug, is arranged in the second well tubular metal structure 101*b* dividing the second well tubular metal structure into a first part 107 and a second part 108. The first part 107 is the part closest to a top of the well.

Figure 2:
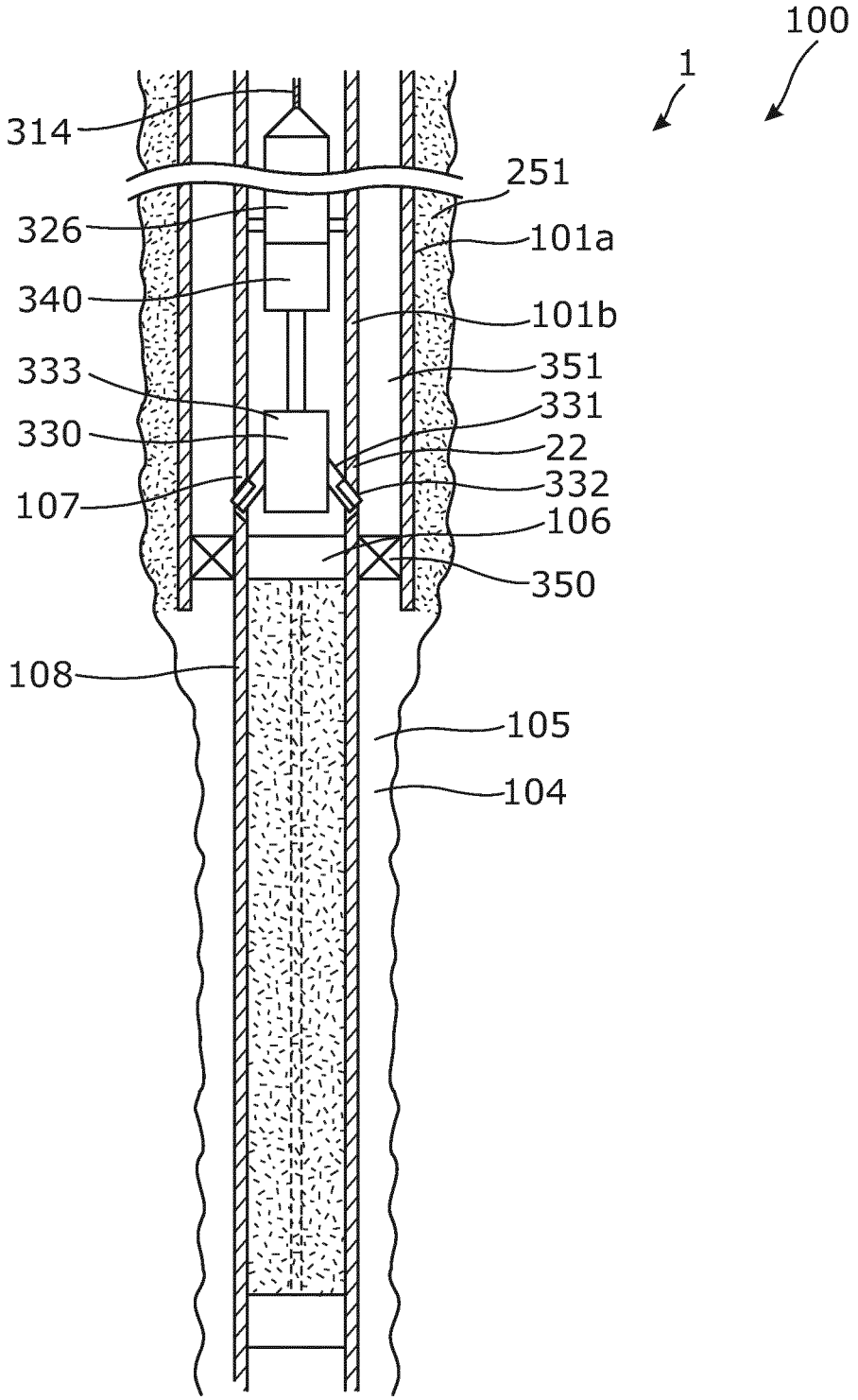
FIG. 2 shows a partly cross-sectional view of the downhole plug and abandonment system of FIG. 1 having a tool string.

As shown in FIG. 2, the downhole plug and abandonment system 100 further comprises a tool string 1 comprising an anchoring tool section 326 and a downhole tubing cutter tool 330. The tool string is arranged in the first part 107 of the second well tubular metal structure 101*b* and the downhole tubing cutter tool 330 comprises a first housing part 333 and a cutting part 331 (329 in FIG. 7) projectable from the first housing part for cutting, milling, grinding, machining or scratching into the metal wall of the well tubular metal structure. Thus, the cutting part has a cutting edge 332 configured to cut in the first part of the second well tubular metal structure, in this embodiment above the packer, in order to provide access to the annular space 351 so as to cement the top part of the well and thus plug the well. To provide a circumferential cut in the well tubular metal structure, the first housing part is rotatable in relation to the anchoring tool section 326 having projectable anchoring parts 327, 328 (shown in FIG. 5). The tip or point of the cutting edge 332 cuts into the well tubular metal structure, dividing the well tubular metal structure into two parts.

In one embodiment, the downhole tubing cutter tool 330 provides several circumferential cuts so that the first part from the top is cut into several tubular sections and pulled out of the well one by one, removing most of the first part of the second well tubular structure before providing cement on top of the first plug and the packer.

Figure 3:
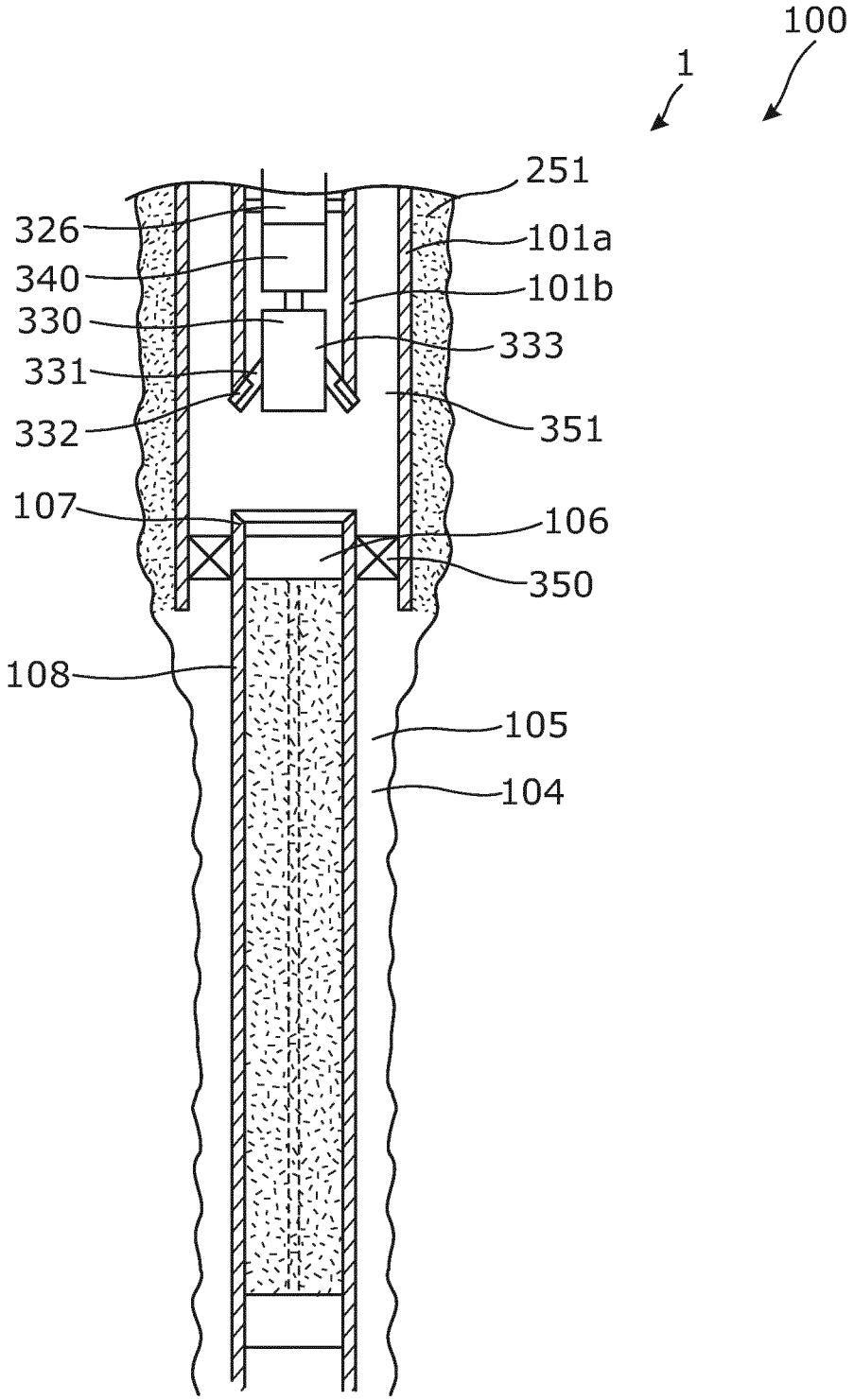
FIG. 3 shows a partly cross-sectional view of the downhole plug and abandonment system of FIG. 2 having a tool string, in which part of the well tubular metal structure has been removed.
Figure 4:
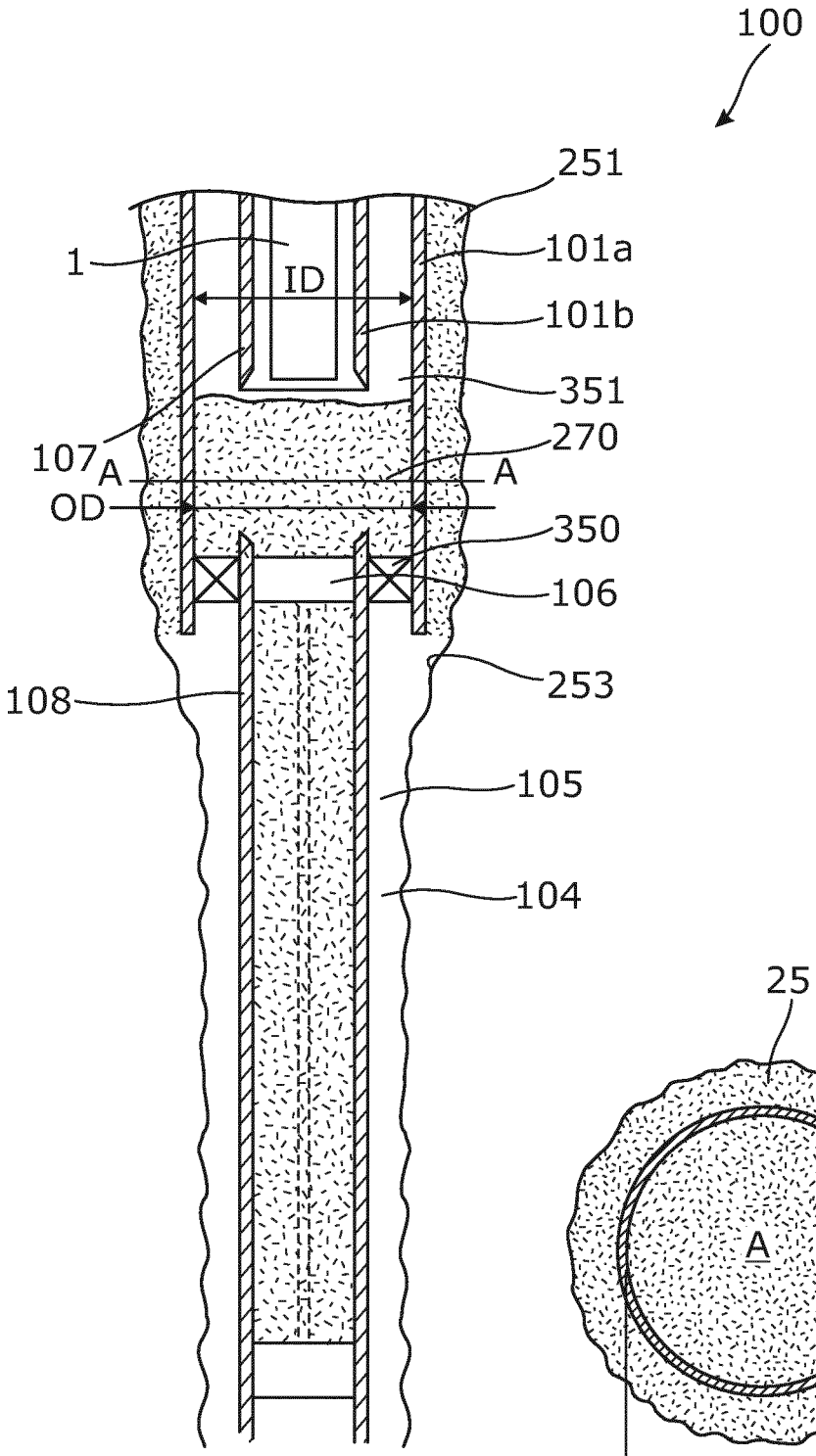
FIG. 4 shows a partly cross-sectional view of the downhole plug and abandonment system of FIG. 3 where cement has been ejected onto the plug and the packer.
Figure 4A:
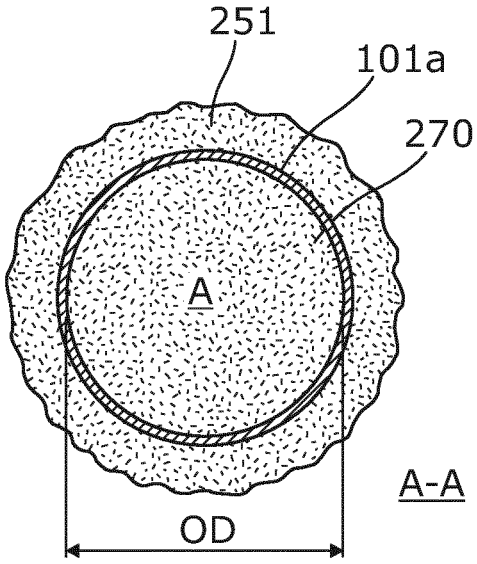
FIG. 4A shows a cross-sectional view A-A of FIG. 4.

As shown in FIG. 2, in order to remove part of the first part of the second well tubular metal structure, the tool string further comprises a stroking tool section 340 configured to move at least the cutting part along the longitudinal extension. The downhole tubing cutter tool 330 is thus capable of cutting a section out of the well tubular structure or, while rotating 360°, also being moved along the well tubular metal structure removing a part of the well tubular structure dividing the first and the second part of the second tubular metal structure, as shown in FIG. 3. The tip or point of the cutting edge 332 cuts into the well tubular metal structure, dividing the well tubular metal structure into two parts, and the upper face of the cutting edge 332 machines, grinds or pulverises the well tubular structure while the stroking tool section moves the cutting edge upwards. Thus, the downhole tubing cutter tool 330, while moving upwards, grinds, machines or pulverises the metal wall providing a circumferential opening in the second well tubular metal structure. Subsequently, cement may be circulated down the second well tubular metal structure and up the annular space, or as shown in FIG. 4, a tool string 1 may be submerged into the second well tubular metal structure 101*b* forming a cement plug 270 on top of the first plug 106 and the packer 350. The cement forms a cement plug 270 in the first well tubular metal structure above the first plug and the packer. The cement plug 270 thus forms a massive cement plug having a cross-sectional area A and extending across the internal cross-sectional area of the second well tubular metal structure. The cement plug is unbroken across the cross-sectional area and no flow lines penetrate the cement plug 270.

The downhole tubing cutter tool 330 provides an opening in the well tubular metal structure 101 so that cement can enter the opening and plug the well as shown in FIG. 4. The tool string 1 is powered and submerged via a wireline 314 as shown in FIG. 2, and thus plugging and abandoning the well can be performed as simple wireline intervention and does no longer require a large rig for pulling the well tubular metal structure 101 out of the well. In the known plug and abandonment operation, a large derrick is installed on top of the well in order to pull the production casing being the well tubular structure out of the well. By providing the opening in the well tubular structure, cementing the well can be performed without having to pull the casing, and thus no large expensive equipment has to be used for the plug and abandonment operation.

Figure 14:
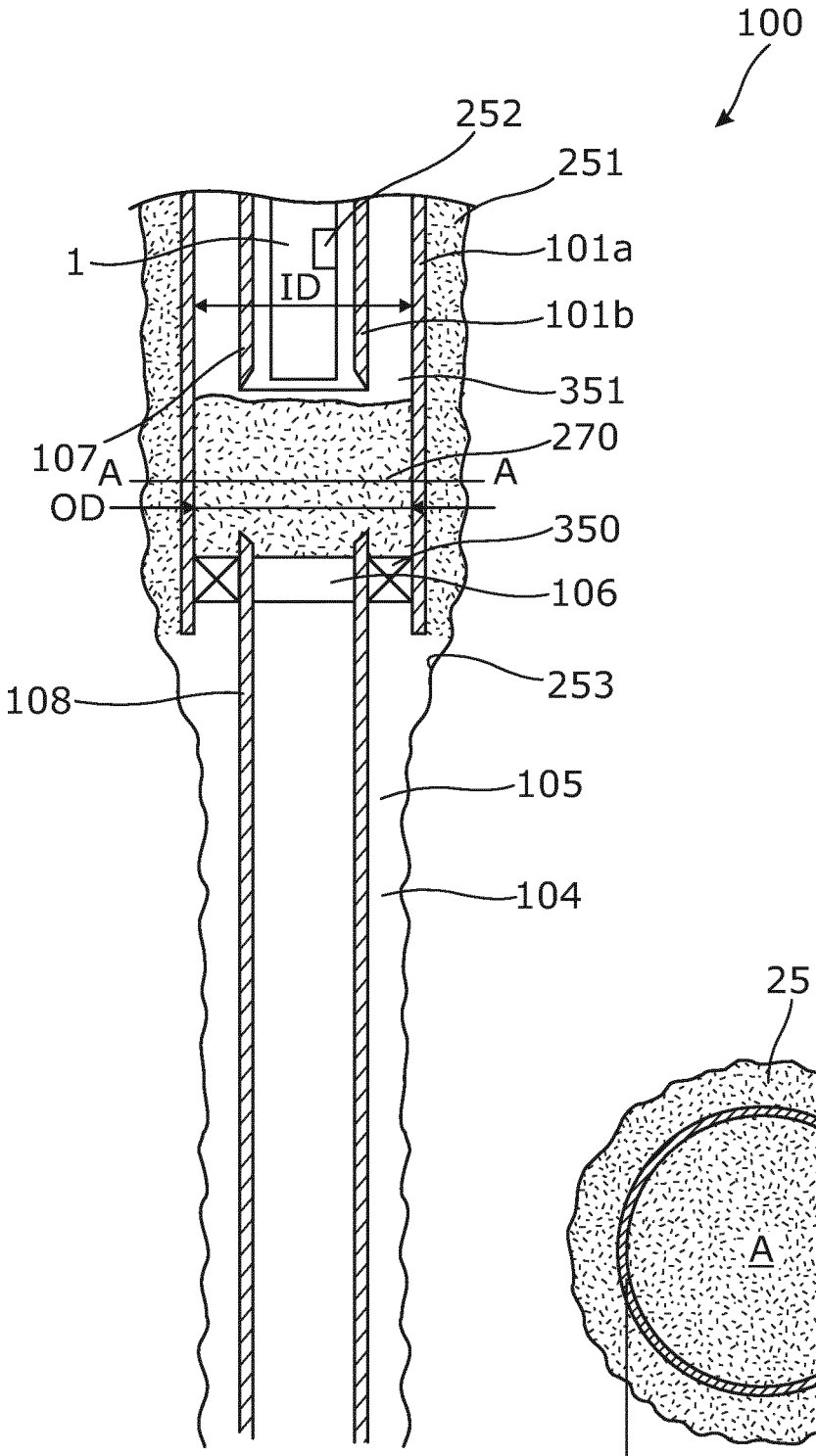
FIG. 14 shows a partly cross-sectional view of another downhole plug and abandonment system.
Figure 14A:
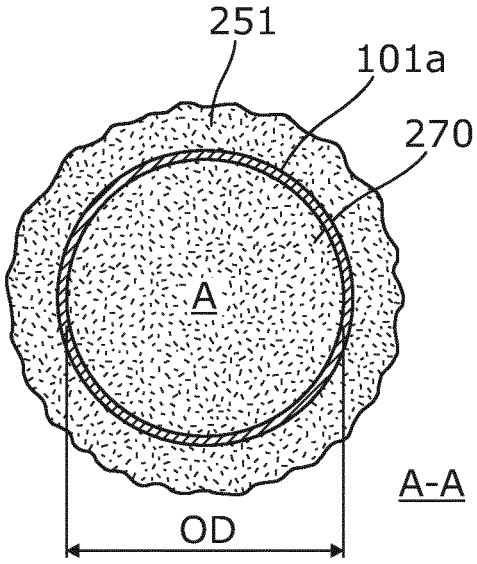
FIG. 14A shows a cross-sectional view A-A of FIG. 4.

Before performing the cement operation to form the cement plug as shown in FIGS. 14 and 14A, the cement layer between the wall 253 of the borehole 104 and the first well tubular metal structure 101*a* is investigated to determine if the cement layer 251 is still intact and has not deteriorated. In this way, the plug and abandonment system ensures that the well 105 is plugged sufficiently to abandon the well and that the well does not leak through an old deteriorated cement layer 251 between the first well tubular metal structure 101*a* and the borehole 104. The first plug 106 is set opposite the packer 350, but it may also be set further down the second well tubular metal structure 101*b*. In FIG. 14, the first plug 106 is not a cement plug but is e.g. another conventional plug, such as a crown plug.

In FIG. 1, the first plug is a cement plug 106 having a first plug part 271 and a second plug part 272, where the plug parts are connected via an elongated connection member 61, such as a chain, a wire, a wireline, a cable, a cord, a rod or a rope. The plug parts are spaced apart along the second well tubular metal structure defining a space 62 between them, which space is filled with cement 63. When setting the plug 106, the second plug part 272 is arranged in the well tubular metal structure and cement is poured on top of the second plug part. The elongated connection member 61 connecting the plug parts is more than 20 metres long, preferably more than 50 metres long and more preferably more than 100 metres long. When the elongated connection member is almost fully surrounded by cement, the first plug part 271 arranged closest to the top of the well is entered into the well tubular metal structure as well, so that the plug parts enclose the cement arranged between them. Subsequently, a pump 64 delivers pressurised fluid pressing onto the first plug part to displace the first plug part, the cement, and the second plug part down inside the second well tubular metal structure to the level opposite the packer. By having two plug parts enclosing the cement as the cement is downwards, the plug parts functioning as pistons seal the cement from being mixed with the well fluid, and the whole well tubular metal structure does not have to be filled up with cement as the second plug part prevents the cement from dumping too far down the well tubular metal structure, since the second plug part is secured to the first plug part by means of the elongated member. Thus, a significant cement plug is set, preventing the well tubular metal structure from being sealed off in an easy and simple manner without using as much cement as in the known solutions for cementing casings.

In the event that the well comprises flow lines, e.g. for controlling a downhole safety valve or other components in the well, the flow lines are cut before performing the cement operation to form the cement plug as shown in FIGS. 14 and 14A. This may be done by means of a downhole tubing cutter tool or a second tool.

Figure 5:
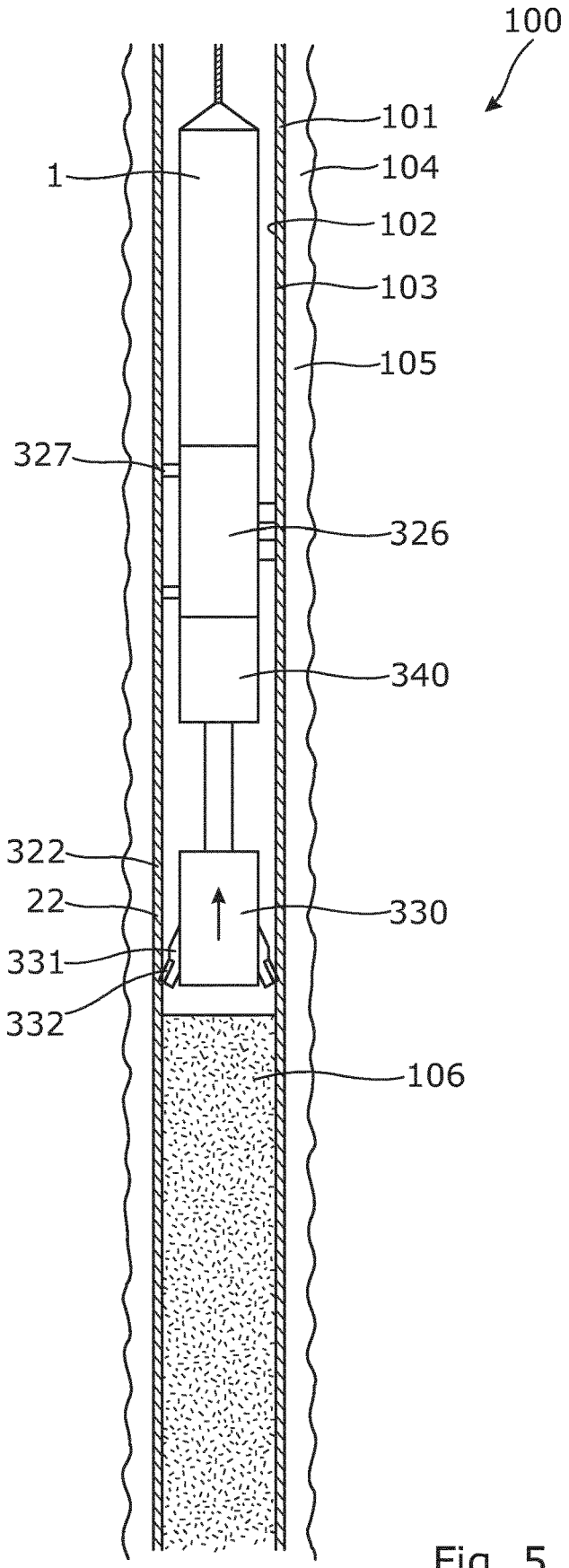
FIG. 5 shows a partly cross-sectional view of another downhole plug and abandonment system having a tool string with a downhole tubing cutter tool and a stroking tool section.

As shown in FIG. 5, the downhole plug and abandonment system may also comprise just one well tubular metal structure at the position in which the structure section 22, 322 is removed to cement the surrounding annulus 104 of the well tubular metal structure.

Figure 6:
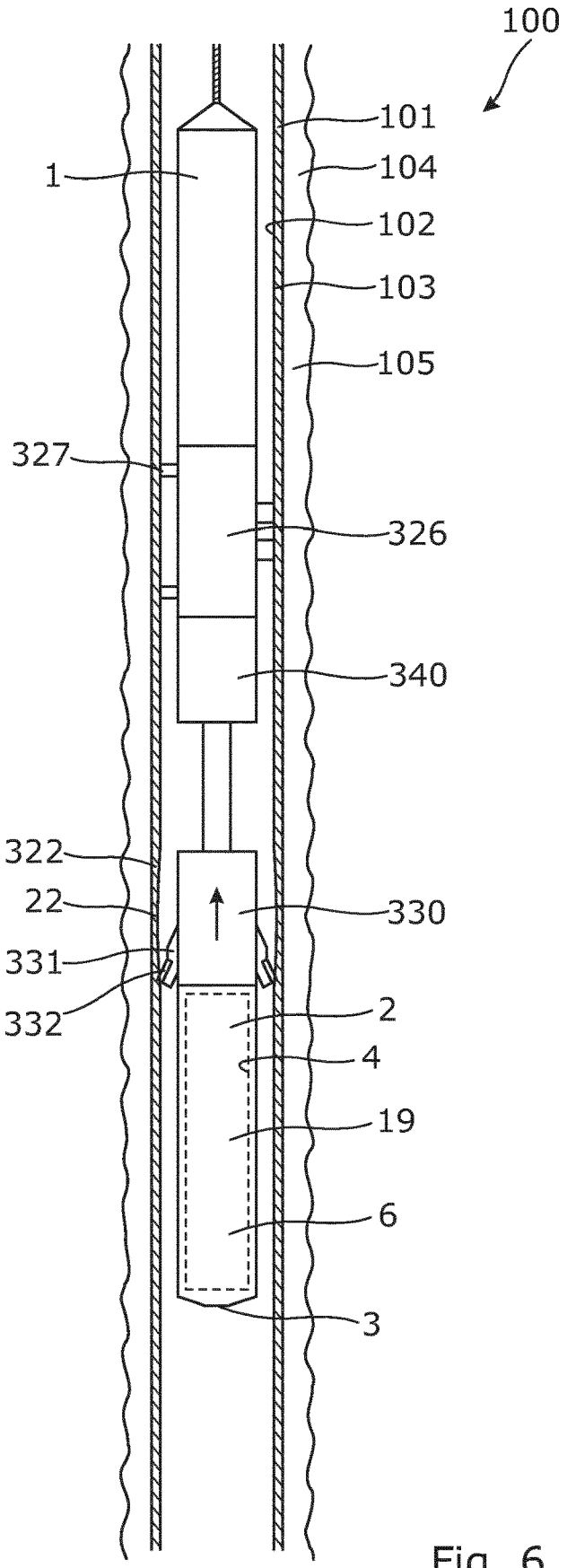
FIG. 6 shows a partly cross-sectional view of another downhole plug and abandonment system having a compartment.
Figure 7:
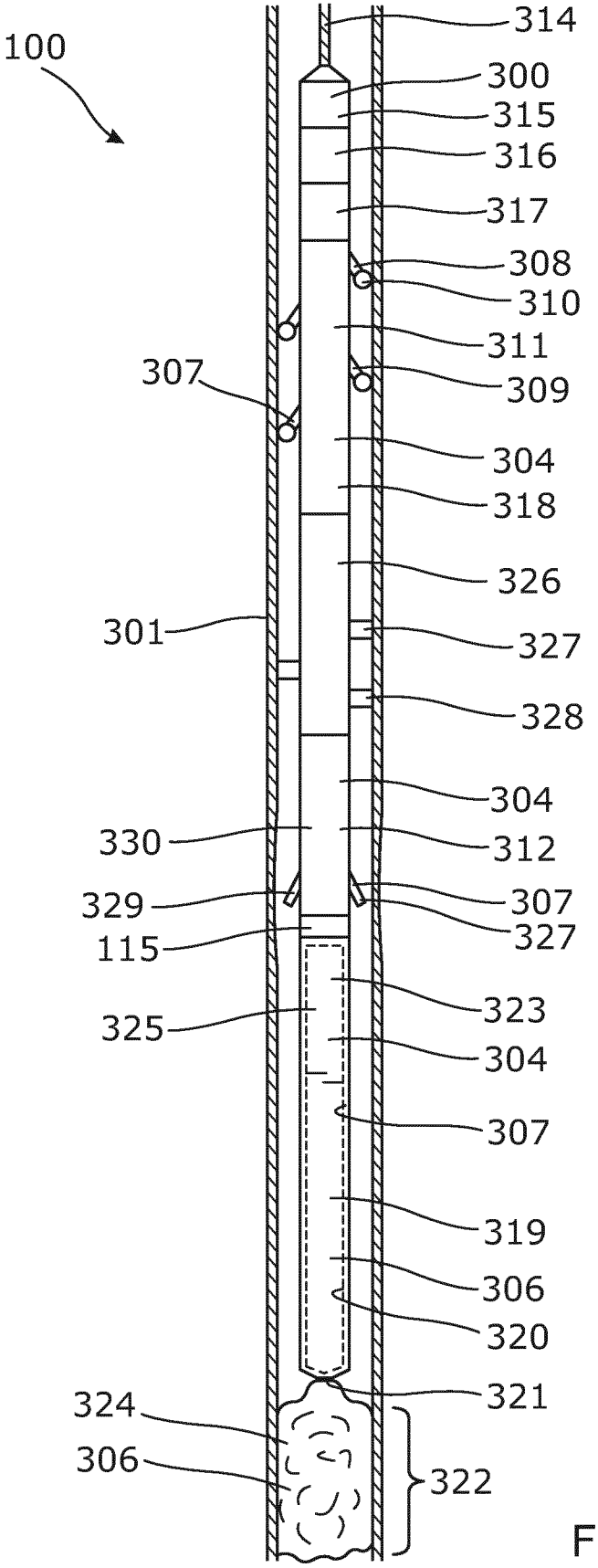
FIG. 7 shows a partly cross-sectional view of another downhole plug and abandonment system.

In FIG. 6, the tool string further comprises a compartment tool section 2 comprising a first compartment 19. The first compartment is configured to contain cement or a corrosive, tempering or modifying fluid or agent. When comprising the corrosive, tempering or modifying fluid or agent 6, the compartment has inner faces 4 covered with a ceramic material, such as SiO. The compartment tool section has an outlet 3 for ejecting the corrosive fluid or agent 6 contained in the first compartment into the well. In FIG. 7, the compartment 319 has also inner faces 320 covered with a ceramic material 307 and is partly filled with corrosive agent 306, and the compartment tool section comprises a second compartment 323 containing a foam generating agent 325, such as a gas or a liquid, which when mixed with the corrosive agent forms a foam 324. The foam is ejected from the outlet 321 as shown in FIG. 7.

In another embodiment, the compartment tool section comprises a foam generating unit having a mixing chamber which is in fluid communication with the first compartment and the second compartment, so that the foam generating agent from the second compartment is mixed with the corrosive fluid or agent in the mixing chamber to provide a corrosive foam to be ejected into the well.

FIG. 7 shows a downhole tool string 300 which is submerged in a well tubular metal structure 301 arranged in a borehole in a well. The tool string comprises a driving section 311 having wheel arms 309 having a wheel 310 for propelling the tool string forward in the well. The tool string 300 comprises an electric section 315, an electric motor 316 and a pump 317 for driving the driving section 311. The tool string 300 comprises a housing 318 mounted from several housing sections for covering each tool section. As shown, the tool string comprises a logging section 115 configured to detect if a part of the structure section has been corroded and to what extent, or if part of the first part of the well tubular metal structure has weak areas.

The tool string may comprise a sampling section for taking a sample of the well fluid present in the well before ejecting the corrosive fluid into the well. The sample is tested for hydrofluoric acid which has to be removed before ejecting the highly corrosive fluid or agent into the well to remove some of the wall of the well tubular metal structure.

In addition, the projectable parts of the downhole tubing cutter tool are moved in a reciprocating movement to scratch the surface and increase the surface area of the structure section, so that the corrosive agent contacts a larger surface area when chemically reacting with the metal surface.

As shown in FIG. 1, the system may comprise a second cutting string 67 for cutting the well tubular metal structures near the seabed or surface to release the well head 68 from the well.

The cutting parts may be arranged so that three or more cutting parts are spaced apart along the circumference of the downhole tubing cutter tool and in several rows of cutting parts along the longitudinal extension of the downhole tubing cutter tool. By having several cutting parts, both along the circumference and along the longitudinal extension, the inner face of the second well tubular metal structure may be sufficiently scratched simply by moving the downhole tubing cutter tool back and forth within the well tubular metal structure, increasing the surface area of the well tubular metal structure and weakening the well tubular metal structure in order that the wall is cut and simply pressed together along the longitudinal extension of the well tubular metal structure, providing an opening through which the cement can enter to plug the well.

Figure 10:
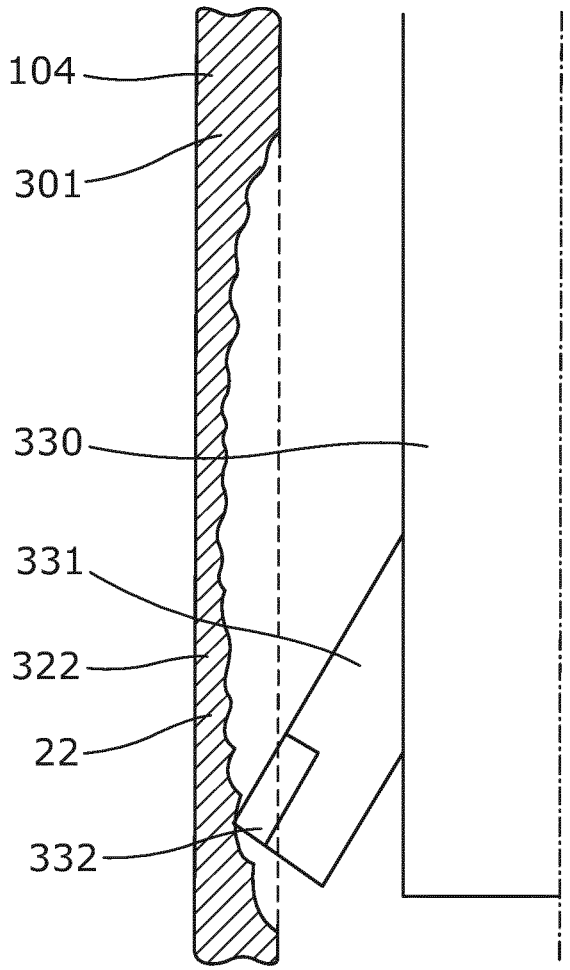
FIG. 10 shows a partly cross-sectional view of another downhole tubing cutter tool.

The ejected corrosive fluid or agent may erode part of the wall of the well tubular metal structure as shown in FIG. 10, and then the downhole tubing cutter tool 330 can more easily cut the remaining part of the wall of the well tubular metal structure.

Figure 8:
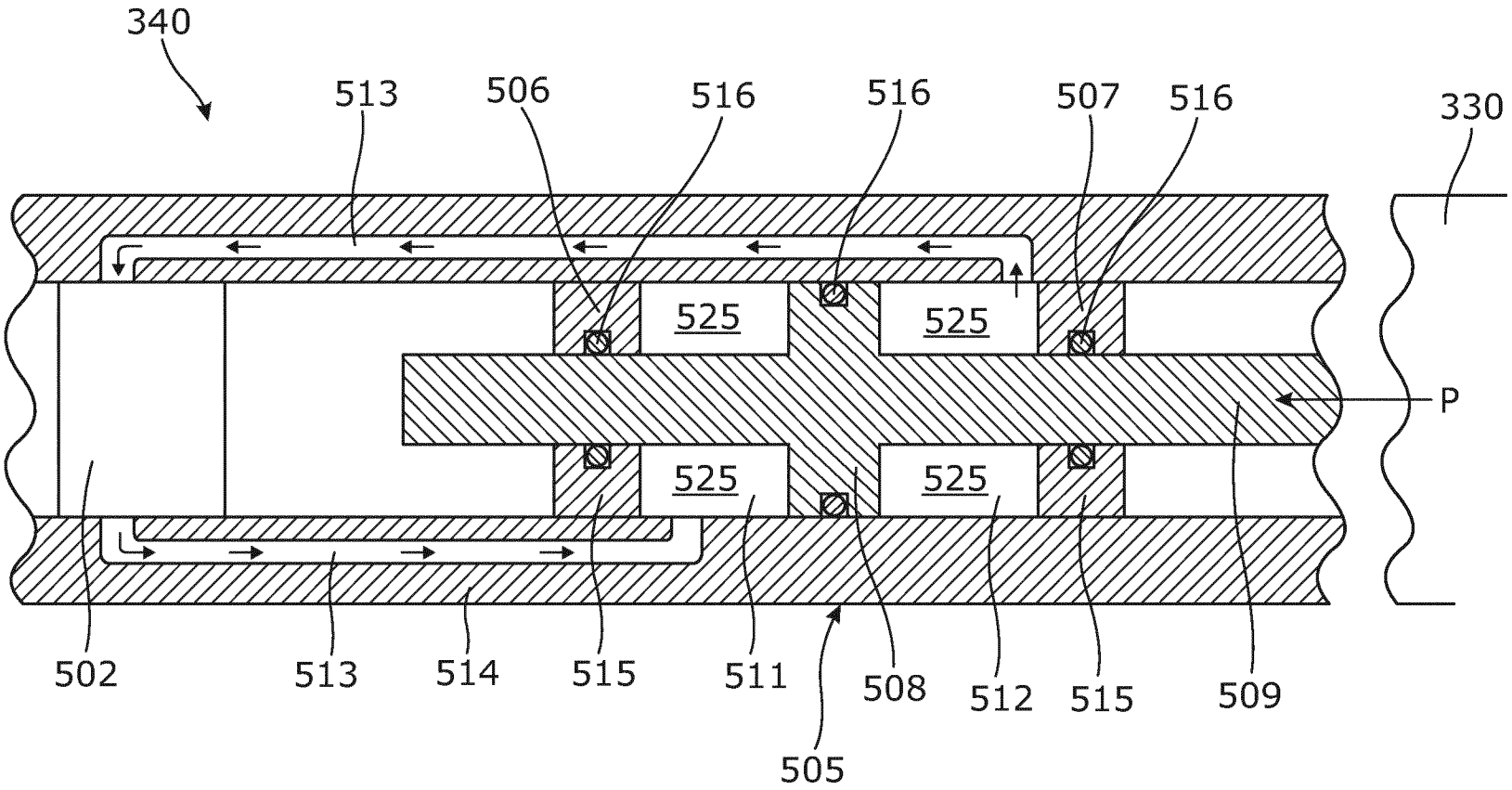
FIG. 8 shows a cross-sectional view of a stroking tool section.

A stroking tool section is a tool providing an axial force. In FIG. 8, the stroking tool section 340 comprises a piston housing 505 which is penetrated by a shaft 509. A piston 508 is provided around the shaft 509 so that the shaft 509 may run back and forth within the housing 505 for providing the axial force P. The piston 508 is provided with a sealing means 516 in order to provide a sealing connection between the inside of the piston housing 505 and the outside of the piston 508. The piston housing 505 comprises a tube 514 which is closed by two rings 515 for defining the piston housing 505. The rings 515 have a sealing means 516, such as an O-ring, in order to provide a sealing connection between the rings 515 and the shaft 509. In this way, the piston housing 505 is divided into two chambers, namely a first chamber 511 and a second chamber 512. Each chamber is fluidly connected to a pump via ducts 513.

The stroking tool section 340 is driven by the motor which drives the pump 502. In FIG. 8, the pump 502 pumps fluid 525 into the first chamber 511 by sucking a corresponding amount of fluid 525 from the second chamber 512, the movement of the fluid being indicated by arrows. Thus, the piston 508 and, consequently, the shaft 509 are driven forward and away from the pump 502, providing an axial force P forward. When the first fluid chamber 511 is substantially filled and the piston 508 is in its rearmost position in relation to the pump 502, the pump 502 shifts its pumping direction and pumps fluid 525 from the first chamber 511 into the second chamber 512. Consequently, the piston 508 is forced backwards towards the pump 502 in the opposite direction of the arrow P. Thus, the fluid 525 is pumped in an opposite direction than the one indicated by the arrows in FIG. 8. In this way, the piston 508 and, consequently, the shaft 509 are forced back and forth and provide the axial force P.

Figure 9:
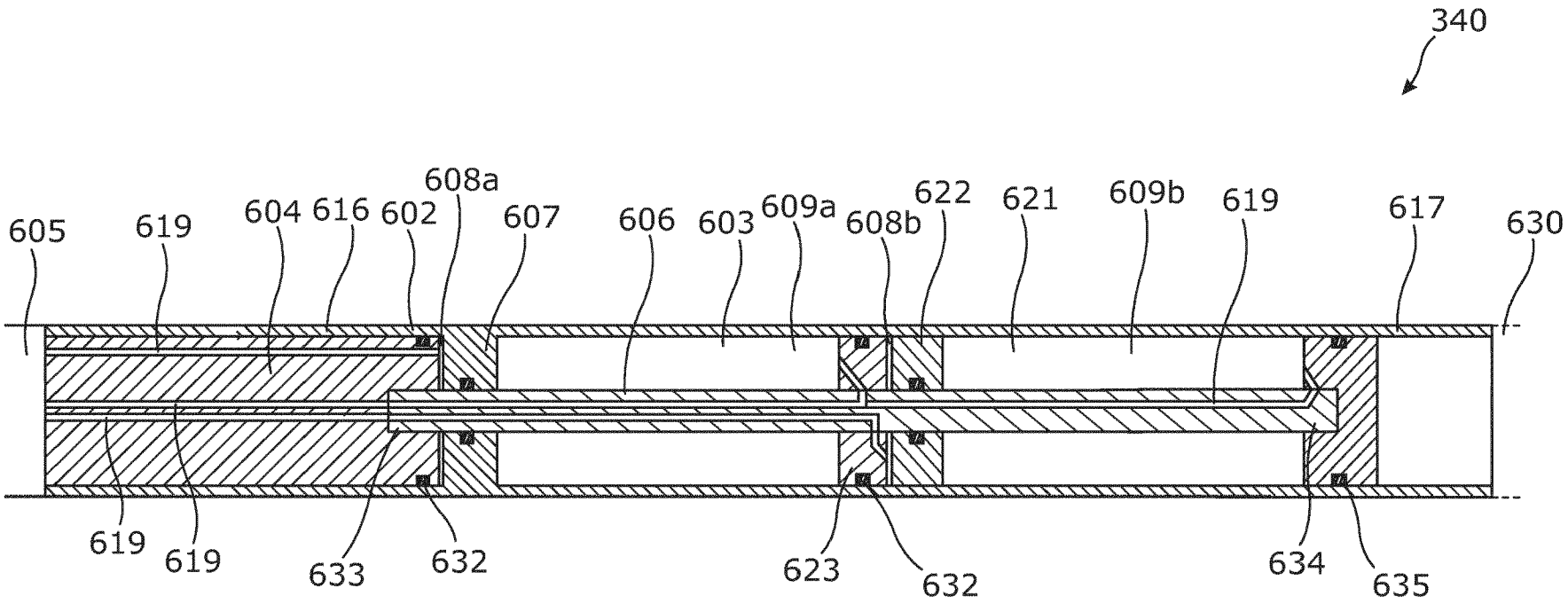
FIG. 9 shows a cross-sectional view of another stroking tool section.

The downhole stroking tool section 340 of FIG. 9 comprises a housing 602, a first chamber inside the tool, and a first tool part 604 comprising a pump unit 605 for providing pressurised fluid to the chamber. The downhole stroking tool section further comprises an electrical motor and an electronic section for controlling the function of the tool. The downhole stroking tool section 340 comprises a shaft 606 penetrating the chamber 603 and a first piston 607 dividing the first chamber into a first chamber section 608 and a second chamber section 609. The piston forms part of the housing which forms part of a second tool part. The second tool part, the housing 602 and the piston 607 are slidable in relation to the shaft 606 and the first tool part 604 in order that the housing moves in relation to the shaft, and the shaft is stationary in relation to the pump unit 605 during pressurisation of the first or of the second chamber section 608, 609. The fluid is fed to one of the chamber sections through a fluid channel 619 in the first part and a fluid channel 619 in the shaft 606 for providing fluid to and/or from the chamber 603 during pressurisation of the first or of the second chamber section 608, 609, generating a pressure on the piston 607. The pressurisation of the first chamber section generates a pressure on the piston and a downstroke in that the housing moves down away from the pump. While fluid is led into the first chamber section 608, fluid is forced out of the second chamber section 609. When providing pressurised fluid into the second chamber section 609, a pressure is generated on the piston, providing an upstroke movement in that the housing moves towards the pump. The shaft is fixedly connected with the first tool part, and the housing is slidable in relation to the first tool part, and a first end part 616 of the housing overlaps the first tool part. When overlapping, the housing is supported partly by the first part, since the first part 604 has an outer diameter which is substantially the same as an inner diameter of the housing. The housing comprises a second end part 617 connected to a connector 630, illustrated by dotted lines. The connector may furthermore be connected to an operational tool, also illustrated with dotted lines.

The downhole stroking tool section according to FIG. 9 further comprises a second chamber 621 divided by a second piston 622. The second chamber comprises a first chamber section 608*b* and a second chamber section 609*b*. The first chamber section 608*b* and a second chamber section 609*b* of the second chamber 621 have the same configuration as the first chamber section 608*a* and a second chamber section 609*a* of the first chamber 603 as they are divided by a piston. The first and the second chambers 603, 621 are both comprised in the housing 602, and both the first piston 607 and the second piston 622 are connected to or form part of the housing and slide along the housing 602. The shaft comprises an intermediate part 623 dividing the first chamber and the second chamber and forming the ends of both the first chamber and the second chamber. Thus, the first chamber 603 is defined by the first tool part 604, the housing 602, the shaft 606 and the intermediate part 623. The second chamber 621 is defined by the intermediate part 623, the housing 602, the shaft 606 and the tool end element 635. The intermediate part supports the housing, also while the housing slides in relation to the intermediate part. As can be seen, the shaft has several fluid channels, one in fluid communication with the second chamber section 609*a* of the first chamber 603 and one in fluid communication with the second chamber section 609*b* of the second chamber 621. A second fluid channel is in fluid communication with the first chamber section 608*b* of the second chamber 621. The fluid communication with the second chamber section 609*b* of the second chamber 621 may be in a separate fluid channel.

Prior to plugging the well, the walls of the well tubular metal structures may be inspected by gamma-ray or x-ray by means of gamma-ray or X-ray transmitters 69 arranged around the well and a detection unit or logging tool 70 in the well, as shown in FIG. 1.

Figure 11:
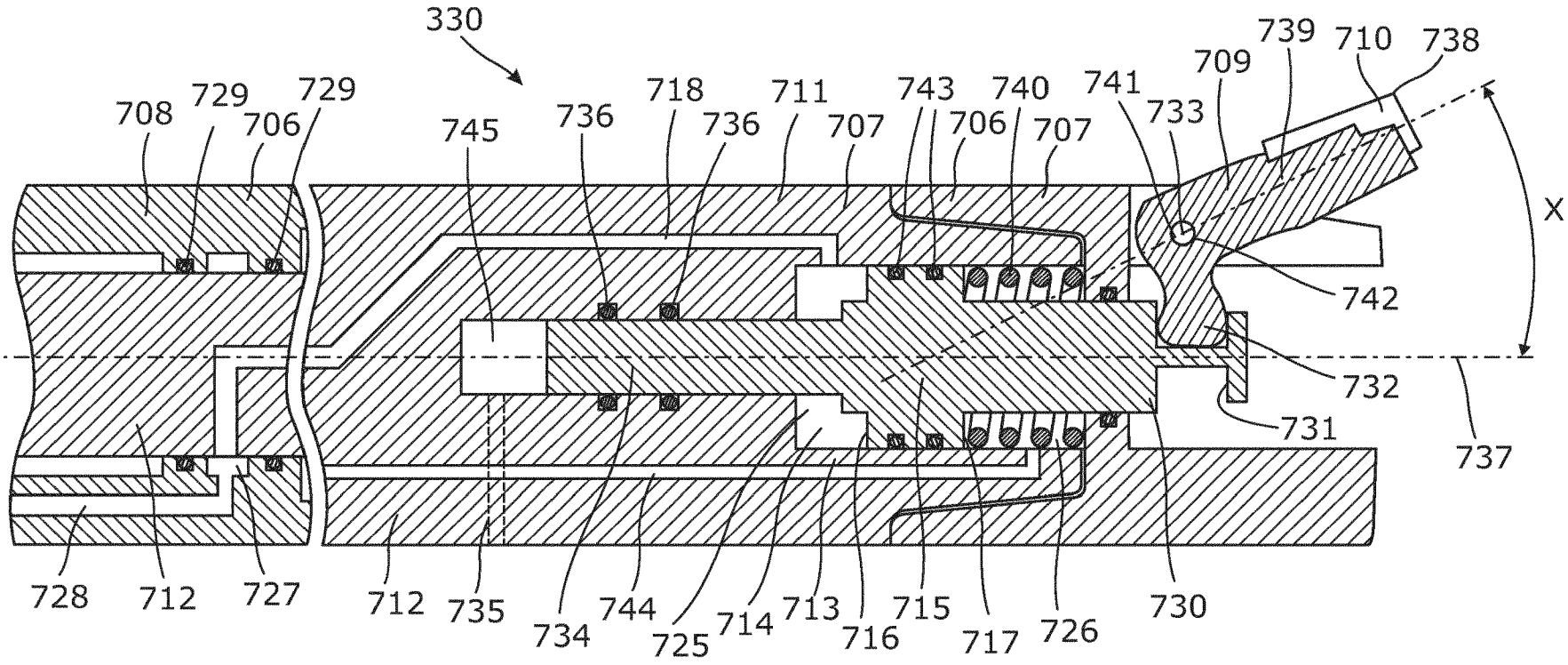
FIG. 11 shows a cross-sectional view of the downhole tubing cutter tool, wherein a cutting part is in its projected position.

As shown in FIG. 11, the downhole tubing cutter tool 330 comprises a tool housing 706 having a first housing part 707 and a second housing part 708 and a cutting part 709 being pivotably connected with the first housing part and having a cutting edge 710 in a first end. The cutting part is movable between a retracted position and a projected position in relation to the tool housing. The cutting part is shown in its projected position in FIG. 11. The tool further comprises a cutting part activation assembly 711 for moving the cutting part 709 between the retracted position and the projected position. A rotatable shaft 712 penetrates the second housing part 708 and is connected with, and forms part of, the first housing part for rotating the cutting part.

The cutting part activation assembly 711 comprises a piston housing 713 arranged in the first housing part 707 and comprising a piston chamber 714. A piston member 715 is arranged inside the piston chamber and engages with the cutting part 709, thereby moving the cutting part 709 between the retracted position and the projected position. The piston member 715 is movable in a longitudinal direction of the downhole tubing cutter tool and has a first piston face 716 and a second piston face 717. Hydraulic fluid from the pump is pumped into a first chamber section 725 of the chamber 714 through a first fluid channel 718, applying a hydraulic pressure on the first piston face 716, and the piston moves in a first direction, applying a projecting force on the cutting part 709.

When the cutting part is projected to pressure against an inner face of the casing or drill pipe and is simultaneously rotated by the motor through the rotatable shaft, the cutting edge 710 is capable of cutting through the casing or drill pipe. Hereby, it is obtained that an upper part of the casing can be separated from a lower part of a casing by cutting the casing from within, without the use of explosives.

In FIG. 11, the rotatable shaft 712 supplies the fluid to the first section 725 of the chamber 714. The fluid from the pump is supplied to the shaft 712 through a circumferential groove 727 fluidly connected with a second fluid channel 728 in the second housing part 708. Thus, the fluid from the second fluid channel 728 is distributed in the circumferential groove 727, so that the first fluid channel 718 in the rotatable shaft 712 is always supplied with pressurised fluid from the pump while rotating. The circumferential groove 727 is sealed off by means of circumferential seals 729, such as O-rings, on both sides of the circumferential groove 727.

The piston member 715 moves in the longitudinal direction of the downhole tubing cutter tool 330 inside the piston chamber and divides the chamber 714 into a first chamber section 725 and a second chamber section 726. When the piston member moves in the first direction, a spring member 740 abutting the second piston face 717 opposite the first piston face 716 is compressed. As the spring member is compressed, so is the second chamber section, and the fluid therein flows out through a fourth channel 744 which is fluidly connected with the first channel 718. The spring member, which is a helical spring surrounding part of the piston member arranged in the second chamber section 726, is thus compressed between the second piston face 717 and the piston chamber 714. The piston member has a first end 730 extending out of the piston housing 713 and engaging the cutting part by having a circumferential groove 731 into which a second end 732 of the cutting part extends. The second end of the cutting part is rounded to be able to rotate in the groove. The cutting part is pivotably connected with the first housing around a pivot point 733. In the other and second end 734 of the piston member, the piston member extends into the shaft 712. When the piston member is moved in the first direction, a space 745 is created between the second end 734 of the piston member and the shaft. This space 745 is in fluid communication with the well fluid through a third channel 735, which is illustrated by a dotted line. In this way, the piston does not have to overcome the pressure surrounding the tool in the well. The second end 734 of the piston member is provided with two circumferential seals 736 in order to seal off the piston chamber from the dirty well fluid.

When the cutting operation is over and the casing or drill pipe has been separated in an upper and a lower part, the hydraulic pressure from the pump is no longer fed to the first channel, and the spring member forces the piston member 715 in a second direction opposite the first direction along the longitudinal direction 737 of the tool, as indicated in FIG. 11.

Figure 12:
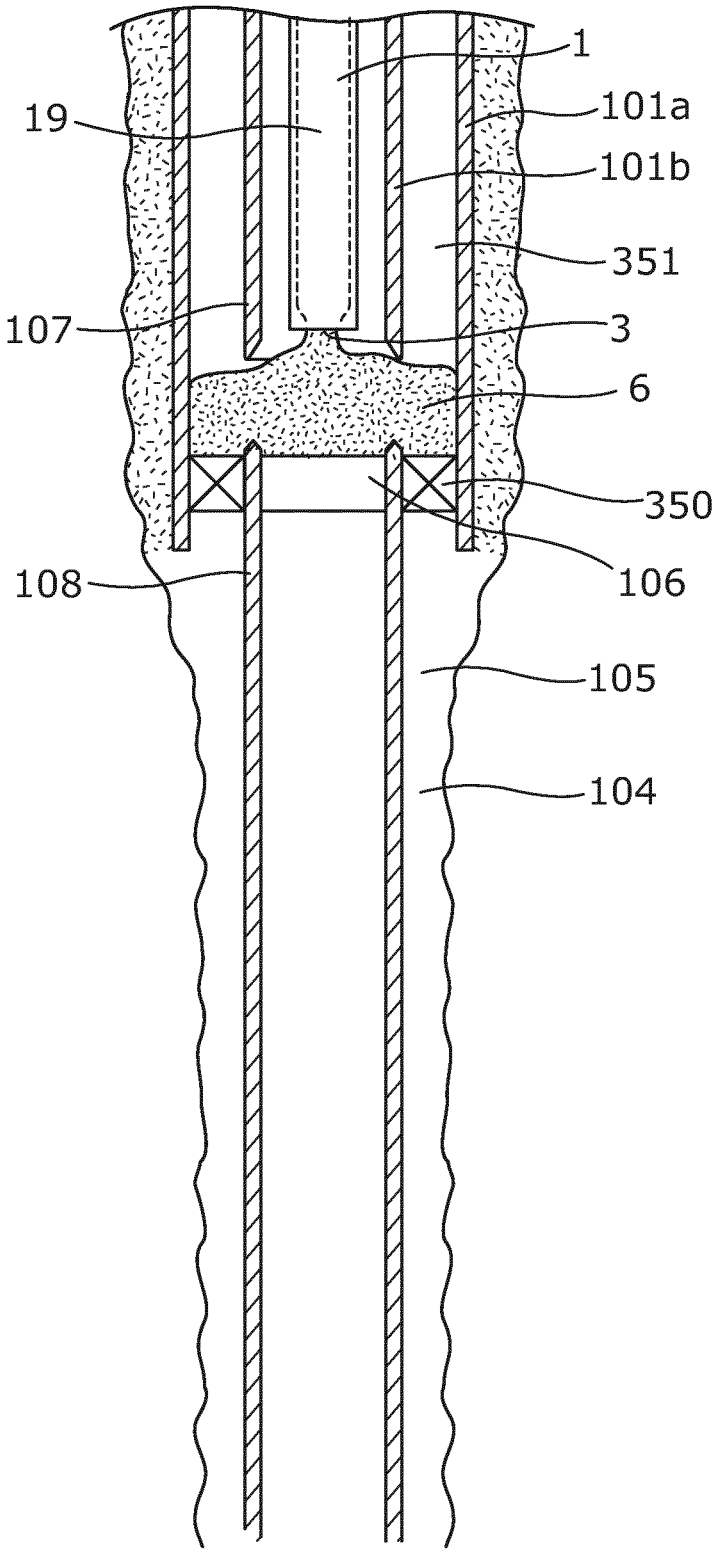
FIG. 12 shows the downhole plug and abandonment system where further corrosive agent is ejected.
Figure 13:
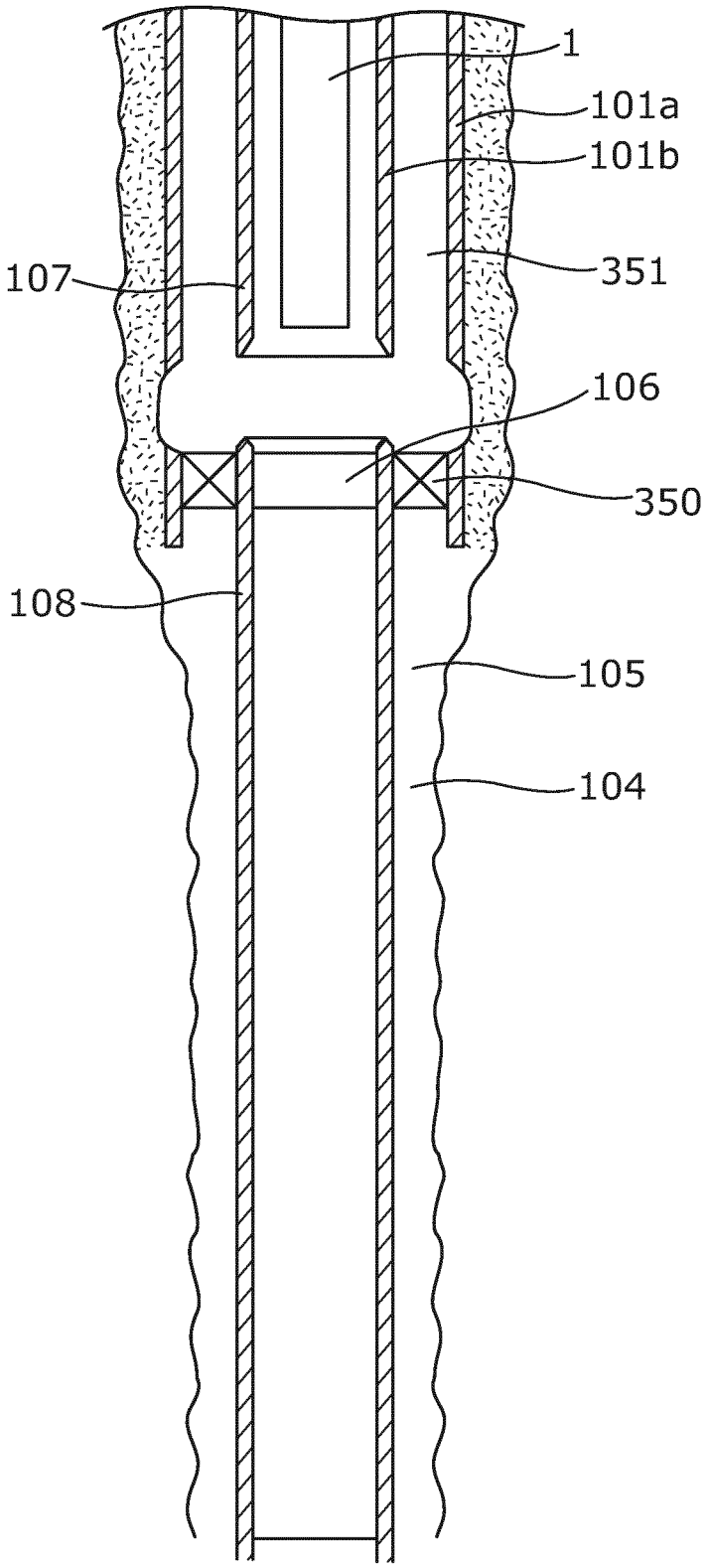
FIG. 13 shows the downhole plug and abandonment system, in which part of the intermediate casing has been removed.

Before plugging the well with cement after cutting an opening, a second portion of corrosive agent 6 may be ejected into the first well tubular metal structure above the plug and the packer to erode part of the first well tubular metal structure, as shown in FIG. 12. A first layer of cement or another protective layer may be arranged on top of the packer and plug before the second portion of corrosive agent is ejected to prevent the packer from being eroded together with the metal wall of the well tubular metal structure. Erosion of the first well tubular metal structure is done to obtain contact with cement adhered to the formation and thus obtain formation contact when cementing above the packer and the plug, as shown in FIG. 13. Subsequently, cement is arranged in a layer on top of the packer and plug, or cement is circulated as described above.

The corrosive fluid or agent may be nitric acid, sulphuric acid or any mixtures thereof. The corrosive fluid or agent is highly corrosive and has a concentration sufficient to erode metal tubing or casing when ejected into well fluid in a well downhole. The agent or fluid may comprise hydrogen sulphide, hydrosulfuric acid or sulfhydric acid, or any mixtures thereof. The agent or fluid may temper or tamper with the metal wall of the structure section so that the wall becomes brittle, which makes it much easier to cut into and pulverise to provide the circumferential opening. Thus, the agent or fluid in the compartment of the tool may be a chemical changing the material properties of the metal in the structure section of the well tubular structure.

Furthermore, a hammering device may be submerged into the second well tubular metal structure to hammer on the part of the well tubular metal structure which is later to be removed by the cutting tool. By hammering onto the metal wall, the metal material is weakened before the cutting process.

The downhole plug and abandonment method comprises the steps of setting a plug in the second well tubular metal structure, positioning a tool string in the second well tubular metal structure above the packer, cutting into the wall of the second well tubular metal structure to provide access to the annular space defined by the first well tubular metal structure and the second well tubular metal structure and the packer, and ejecting cement into the second well tubular metal structure and into the annular space.

In the downhole plug and abandonment method, the step of cutting into the wall is performed by moving the cutting part in the longitudinal extension of the second well tubular metal structure.

Furthermore, the downhole plug and abandonment method comprises a step of inspecting the walls of the well tubular metal structures before the step of cutting. This step of inspecting the walls is performed by gamma-ray or x-ray by means of gamma-ray or X-ray transmitters 69 arranged around the well and a detection unit or logging tool 70 in the well.

The downhole plug and abandonment method furthermore comprises the steps of arranging the first compartment of the downhole tool string in the first part of the well tubular metal structure adjacent the structure section, ejecting the corrosive fluid or agent or corrosive foam into the structure section from the tool section, and corroding the metal wall of the structure section partly or fully from the inside of the structure section to provide a decreased wall thickness of the structure section before cutting.

Moreover, the downhole plug and abandonment method comprises the steps of taking a sample of a well fluid in the well tubular metal structure at least before the step of ejecting the corrosive fluid or agent or corrosive foam, and detecting a content of the well fluid.

The downhole plug and abandonment method further comprises the steps of cutting a section of the second well tubular metal structure, retracting the section from the well, cutting additional sections of the second well tubular metal structure and retracting the additional sections from the well until reaching a predetermined distance above the packer and plug.

The downhole plug and abandonment method further comprises the step of circulating cement down through the second well tubular metal structure and up through the annular space, until cement is detected in a top part of the annular space, in order to ensure that the annular space is substantially filled with cement.

Furthermore, the downhole plug and abandonment method comprises the steps of cutting the first well tubular metal structure and the second well tubular metal structure at a distance from the top of the well to remove the well head, arranging the stroking tool section in the top of the second well tubular metal structure, releasing the well head by providing an axial stroke of the stroking tool section, and cutting control lines extending in the annular space.

In the downhole plug and abandonment method, the step of setting the plug comprises the steps of inserting the second plug part into the second well tubular metal structure, ejecting cement onto the second plug part while displacing the second plug part into the second well tubular metal structure and the elongated connection member, and inserting the first plug part into the second well tubular metal structure when the elongated connection member is run out of length and the space between the second plug part and the first plug part has been substantially filled with cement.

The downhole plug and abandonment method furthermore comprises the steps of pressurising a fluid via a pump at the top of the well, and delivering the pressurised fluid onto the first plug part for displacing the plug in the second well tubular metal structure.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or production tubing is meant any kind of pipe, tubing, tubular, liner, string etc. used downhole in relation to oil or natural gas production. The first well tubular metal structure may thus be an intermediate or conductor casing and the second well tubular metal structure may be the production casing or tubing.

In the event that the tool is not submergible all the way into the casing, a downhole tractor 304 can be used to push the tool all the way into position in the well, as shown in FIG. 7. The downhole tractor may have projectable arms 308, 309 having wheels 310, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole plug and abandonment system for a well, comprising:

a first well tubular metal structure having a wall, a second well tubular metal structure having a wall, the second well tubular metal structure being arranged inside the first well tubular metal structure, the well tubular metal structures having longitudinal extensions and being arranged in a borehole of the well, a packer arranged between the first well tubular metal structure and the second well tubular metal structure defining an annular space above the packer, a first plug arranged in the second well tubular metal structure dividing the second well tubular metal structure into a first part and a second part, the first part being closest to a top of the well, a cement plug arranged in the first well tubular structure and on top of and in direct contact with both the packer and the first plug, and a tool string comprising:

an anchoring tool section, and a downhole tubing cutter tool arranged in the first part of the second well tubular metal structure, the cutter tool comprising:

a first housing part, and a cutting part projectable from the first housing part, the cutting part having a cutting edge configured to cut in the first part of the second well tubular metal structure for providing access to the annular space, the first housing part being rotatable in relation to the anchoring tool section.

2. A downhole plug and abandonment system according to claim 1, wherein the cement plug has an outer diameter being equal to an inner diameter of the first well tubular metal structure.

3. A downhole plug and abandonment system according to claim 1, wherein the cement plug has a cross-sectional area and the cement plug is unbroken across the cross-sectional area.

4. A downhole plug and abandonment system according to claim 1, wherein the tool string is connected to a wireline.

5. A downhole plug and abandonment system according to claim 1, wherein the first plug is a cement plug.

6. A downhole plug and abandonment system according to claim 1, wherein the tool string further comprises a stroking tool section configured to move at least the cutting part along the longitudinal extension to remove part of the first part of the second well tubular metal structure without pulling the first part of the second well tubular structure out of the well.

7. A downhole plug and abandonment system according to claim 1, wherein the tool string comprises a compartment tool section comprising a first compartment having inner faces.

8. A downhole plug and abandonment system according to claim 7, wherein the first compartment contains a corrosive fluid or agent during the submersion of the downhole tool string into the well, and the compartment tool section has an outlet for ejecting the corrosive fluid or agent contained in the first compartment into the well.

9. A downhole plug and abandonment method according to claim 1, wherein the cement plug spans an entire diameter of the first well tubular metal structure.

10. A downhole plug and abandonment system for a well, the system comprising:

a first well tubular metal structure having a wall, a second well tubular metal structure having a wall, the second well tubular metal structure being arranged inside the first well tubular metal structure, the well tubular metal structures having longitudinal extensions and being arranged in a borehole of the well, a packer arranged between the first well tubular metal structure and the second well tubular metal structure defining an annular space above the packer, a first plug arranged in the second well tubular metal structure dividing the second well tubular metal structure into a first part and a second part, the first part being closest to a top of the well, and a cement plug arranged in the first well tubular structure and on top of and in direct contact with both the packer and the first plug, wherein the first plug comprises a first plug part and a second plug part, the plug parts being connected via an elongated connection member and spaced apart along the second well tubular metal structure defining a space, which space comprises cement.

11. A downhole plug and abandonment system according to claim 10, wherein the system further comprises a pump configured to deliver pressurised fluid pressing onto the first plug part to displace the first plug in the second well tubular metal structure.

12. A downhole plug and abandonment method for operating a downhole plug and abandonment system for a well, the system comprising:

a first well tubular metal structure having a wall, a second well tubular metal structure having a wall, the second well tubular metal structure being arranged inside the first well tubular metal structure, the well tubular metal structures having longitudinal extensions and being arranged in a borehole of the well, a packer arranged between the first well tubular metal structure and the second well tubular metal structure defining an annular space above the packer, a first plug arranged in the second well tubular metal structure dividing the second well tubular metal structure into a first part and a second part, the first part being closest to a top of the well, and a cement plug arranged in the first well tubular structure and on top of and in direct contact with both the packer and the first plug, the method comprising:

setting a first plug in the second well tubular metal structure of the downhole plug and abandonment system, positioning a tool string in the second well tubular metal structure above the packer, cutting into the wall of the second well tubular metal structure to provide access to the annular space defined by the first well tubular metal structure and the second well tubular metal structure and the packer, and ejecting cement into the second well tubular metal structure and into the annular space.

13. A downhole plug and abandonment method according to claim 12, wherein before ejecting cement, the method further comprises investigating a cement layer arranged between the wall of the borehole and the first well tubular metal structure.

14. A downhole plug and abandonment method according to claim 13, wherein investigating the cement layer arranged between the wall of the borehole and the first well tubular metal structure is performed by means of an ultrasonic tool positioned in the first well tubular metal structure.

15. A downhole plug and abandonment method according to claim 12, wherein cutting into the wall is performed by moving the cutting part in the longitudinal extension of the second well tubular metal structure.

16. A downhole plug and abandonment method according to claim 12, further comprising:

inspecting the walls of the well tubular metal structures before cutting.

17. A downhole plug and abandonment method according to claim 12, further comprising:

circulating cement down through the second well tubular metal structure and up through the annular space, until cement is detected in a top part of the annular space, in order to ensure that the annular space is substantially filled with cement.

18. A downhole plug and abandonment method according to claim 12, wherein setting the plug comprises:

inserting a second plug part of the first plug into the second well tubular metal structure, ejecting cement onto the second plug part while displacing the second plug part into the second well tubular metal structure and an elongated connection member that connects a first plug part and the second plug part, and inserting the first plug part into the second well tubular metal structure when the elongated connection member is run out of length and the space between the second plug part and the first plug part has been substantially filled with cement.

19. A downhole plug and abandonment method according to claim 18, further comprising:

pressurising a fluid via a pump at the top of the well, and delivering the pressurised fluid onto the first plug part for displacing the plug in the second well tubular metal structure.

20. A downhole plug and abandonment method according to claim 12, further comprising cutting at least one flow line.

* * * * *